US005115384A

United States Patent [19]

Loth et al.

[11] Patent Number: 5,115,384

[45] Date of Patent: May 19, 1992

[54] SOFT LIGHT

[75] Inventors: Stanislaw Loth, Nanuet, N.Y.; Volker W. Bahnemann, Greenwich, Conn.

[73] Assignee: Arriflex Corporation

[21] Appl. No.: 614,506

[22] Filed: Nov. 15, 1990

[51] Int. Cl.[5] ..... F21V 7/00

[52] U.S. Cl. ..... 362/301; 362/18; 362/298; 362/319; 362/346

[58] Field of Search ..... 362/16, 17, 18, 217, 362/279, 291, 298, 301, 310, 319, 346, 349, 362

[56] References Cited

U.S. PATENT DOCUMENTS 3,586,851 6/1971 Rudolph ..... 362/301 X 4,599,684 7/1986 Lee ..... 362/301 X

*Primary Examiner*—Stephen F. Husar

*Attorney, Agent, or Firm*—Toren, McGeady & Associates

[57] ABSTRACT

A soft light having a housing with a front opening and a hinged upper portion, a light source arranged in a lower frontal position in the housing, an internal reflector for direction light from the light source toward a rear portion of the housing opposite the front opening, and a rear reflector removably mounted in the housing so as to reflect the light from the light source and the internal reflector out of the front opening of the housing.

10 Claims, 4 Drawing Sheets

SOFT LIGHT

BACKGROUND OF THE INVENTION

The present invention relates to lighting for use in photography and cinematography, and more particularly to what is known in the art as soft lights.

Soft lights are light sources in which all of the light emitted from a light bulb is reflected from a white "soft" reflector surface, and then out towards a subject. The soft light reduces harsh shadows in direct proportion to the size of the "soft" reflector. To keep light output even, the rear reflector is usually deeply curved so that no direct light from the light bulb can escape outside the housing of the soft light.

FIG. 1 shows a typical soft light using a deeply curved reflector with a light bulb 1, a light bulb reflector 2 and a spherical reflector 3. A light beam L2 shielded by the deeply curved reflector cannot escape directly outside the light housing without first being reflected from the spherical reflector 3.

However, this type of soft light construction has several disadvantages, namely, the reflector configuration makes the soft light bulky, in other words, the height and depth are about equal. Additionally, the soft light, because of heat build-up from its "closed" design and limited air flow, results in damage to the white reflector surface, and it is difficult to re-paint or clean. For the same reason, color gels cannot be used directly in front of the soft light's opening but need to be attached on extensions at least one foot away from the light. Furthermore, the spherical reflector 3 reflects at the center light beam L2 more light than at the edge light beam L1, which results in uneven light output. To compensate for this the reflector surface has a rough texture.

SUMMARY OF THE INVENTION

Accordingly, it is an object of the present invention to provide a soft light which eliminates the abovediscussed disadvantages associated with the prior art.

It is a further object to provide a soft light which permits easy interchangeability of various rear reflectors from "soft" to hammer-tone metallic and colored. This interchangeability allows the color temperature of the light to be changed which eliminates the problem of melting gels placed in front of the light.

Furthermore, it is an object of the present invention to provide a soft light which permits use of an adjustable reflector which provides an adjustable light output without changing the color temperature of the light.

A further object is to provide a soft light having a housing which is of a reduced depth and provides better airflow for reflector cooling as compared with prior art constructions.

Pursuant to these objects, and those which will become apparent hereafter, one aspect of the present invention resides in a soft light having a housing with a relatively shallow depth, a light bulb arranged in the lower frontal portion of the housing and partially surrounded by a spherical reflector. Internal mirror reflectors are arranged at a side of the light bulb not surrounded by the spherical reflector, so as to diverge from one another. The internal mirror reflectors and spherical reflector are arranged so as to direct light from the light bulb toward an interchangeable rear reflector which is arranged in the housing at the back wall thereof. The housing has an opening opposite to the rear reflector so as to allow light to escape from the housing. The housing also has a hinged portion which allows the rear reflector to be accessed and interchanged.

The novel features which are considered as characteristic for the invention are set forth and particular in the appended claims. The invention itself, however, both adds to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
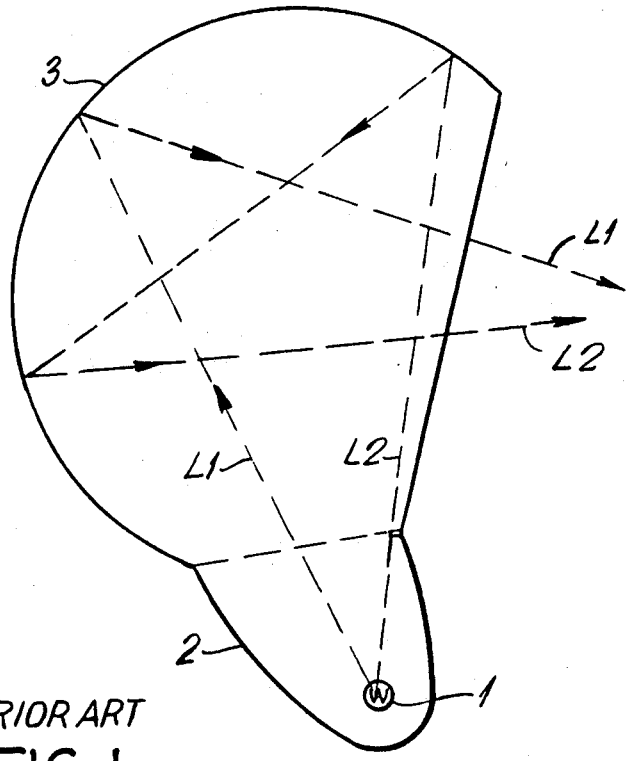
PRIOR ART FIG. 1
FIG. 1 is a schematic illustration of a prior art soft light.
Figure 2:
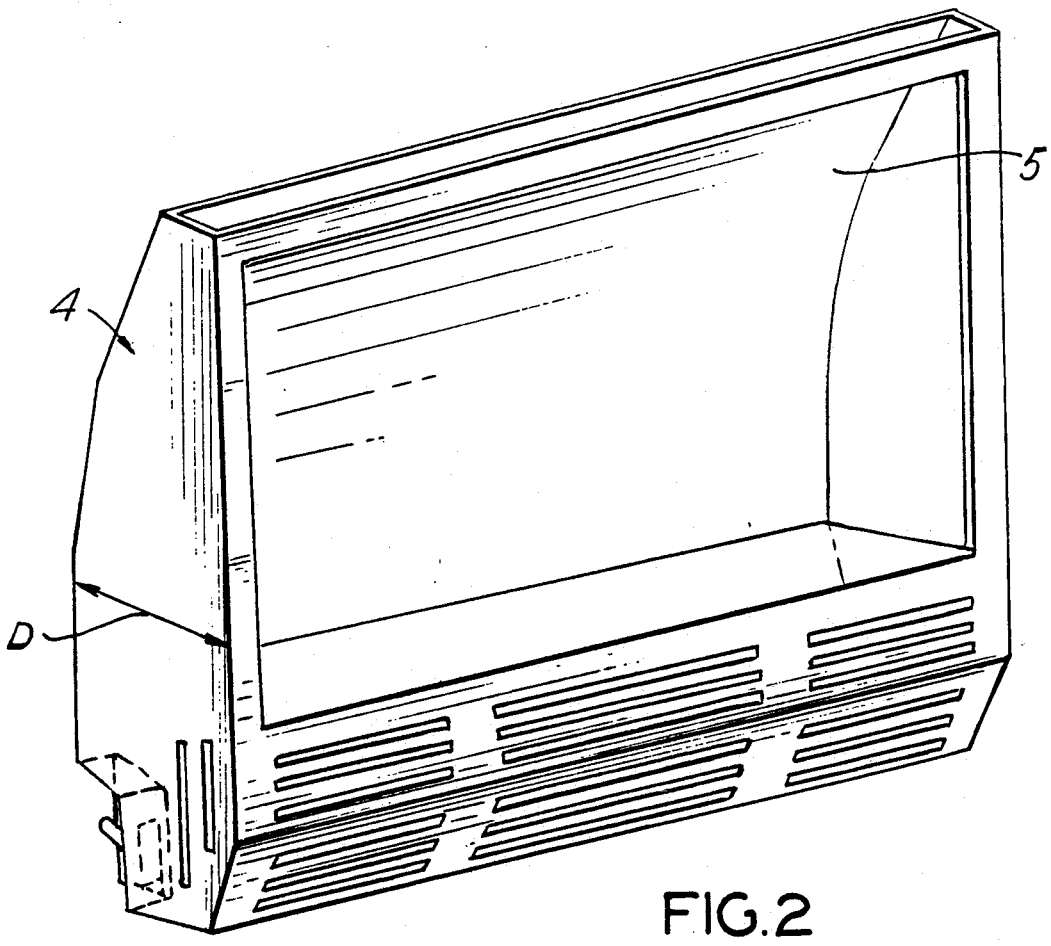
FIG. 2 is a perspective view of a soft light pursuant to the present invention.

FIG. 2 shows a perspective view of the soft light pursuant to the present invention, which soft light includes a housing 4 having a relatively shallow depth D. A rear reflector 5 is arranged inside the housing so as to project light out of the opening 6 of the housing. The rear reflector 5 is mounted so as to be interchangeable so that various different types of rear reflectors can be used in the housing.

Figure 3:
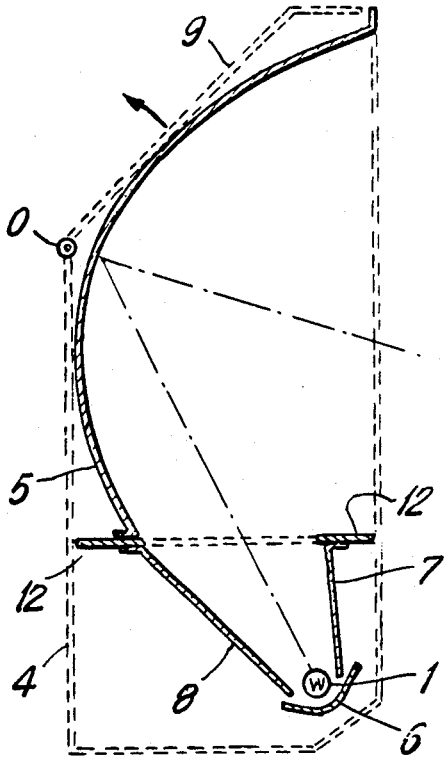
FIG. 3 is a cross-section of FIG. 2.

FIG. 3 is a cross-section through the soft light shown in FIG. 2, and it can be seen from this Figure that a light bulb 1 is arranged in the lower frontal portion of the housing, and is partially surrounded on its lower side by a spherical reflector 6.

On the side of the bulb 1 opposite the spherical reflector 6, internal mirror reflectors 7, 8 are fixed to the housing 4 so as to diverge from one another from a point beginning near the light bulb. The housing 4 is provided with an upper hinged portion 9 which is hinged to the rest of the housing at a pivot point 0. This hinged portion 9 allows the housing 4 to be opened and permits the rear reflector 5 to be removed and interchanged as desired.

Figure 4:
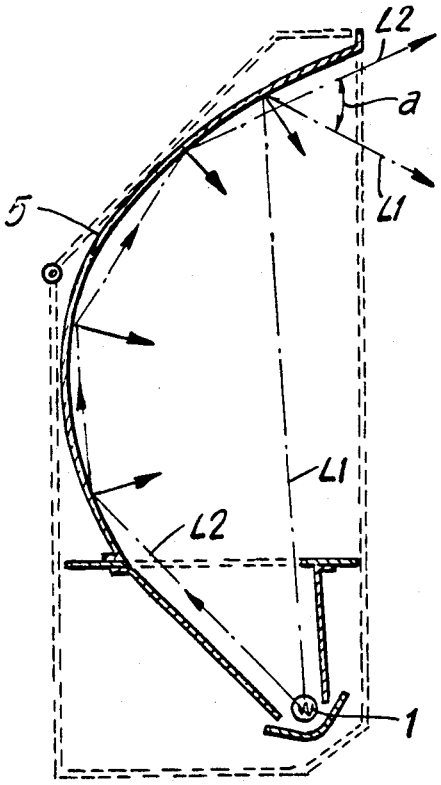
FIG. 4 is a view similar to FIG. 3, showing the path of two light beams.

FIG. 4 shows light beams L1 and L2 which are emitted from the light bulb 1 and reflected from the rear reflector 5. The angle "a" is the vertical light output angle when using a "harsh" hammer-tone reflector as the rear reflector 5. If desired, the rear reflector 5 can also be a mirror-type rear reflector.

Figure 5:
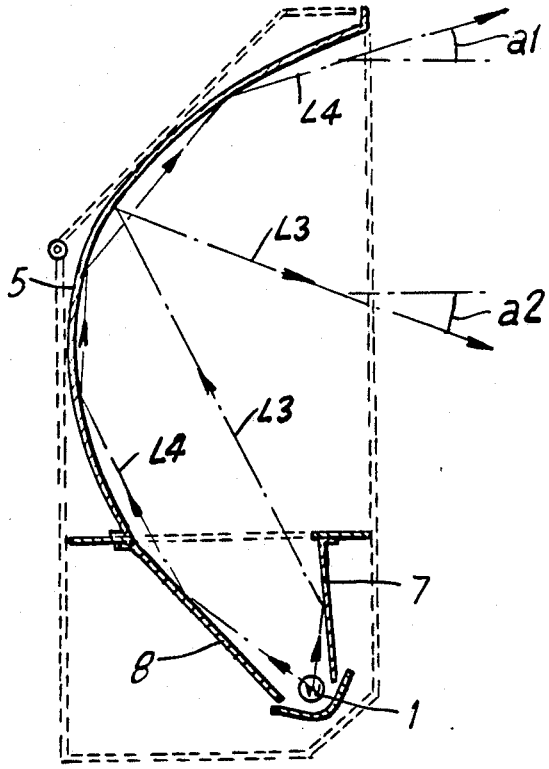
FIG. 5 is a view similar to FIG. 3, showing the path of two additional light beams.

FIG. 5 shows light beams L3 and L4 from the light bulb 1, which are respectively reflected off of the mirror reflectors 7, 8, and are further reflected by the rear reflector 5. The vertical angle of light output "a" is equal to a1=a2, supporting the light output angle "a" of FIG. 4. This shows that the low-angle reflection of the reflectors 7 and 8 provides even illumination to the entire rear reflector 5 without using a typical ellipsoid bulb-reflector.

Figure 6:
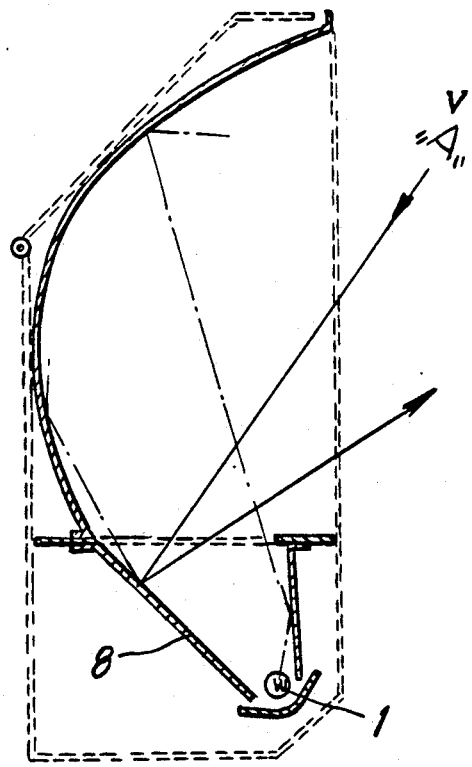
FIG. 6 is a view similar to FIG. 3 showing the positioning of the internal mirror reflectors.

FIG. 6 shows the position of the reflector 8 and illustrates that no direct light from the light bulb 1 can escape outside the housing 4. To a viewer V, looking inside the housing 4, the surface of the reflector 8 will appear black since the viewer cannot see a reflection of the light source 1.

Figure 7:
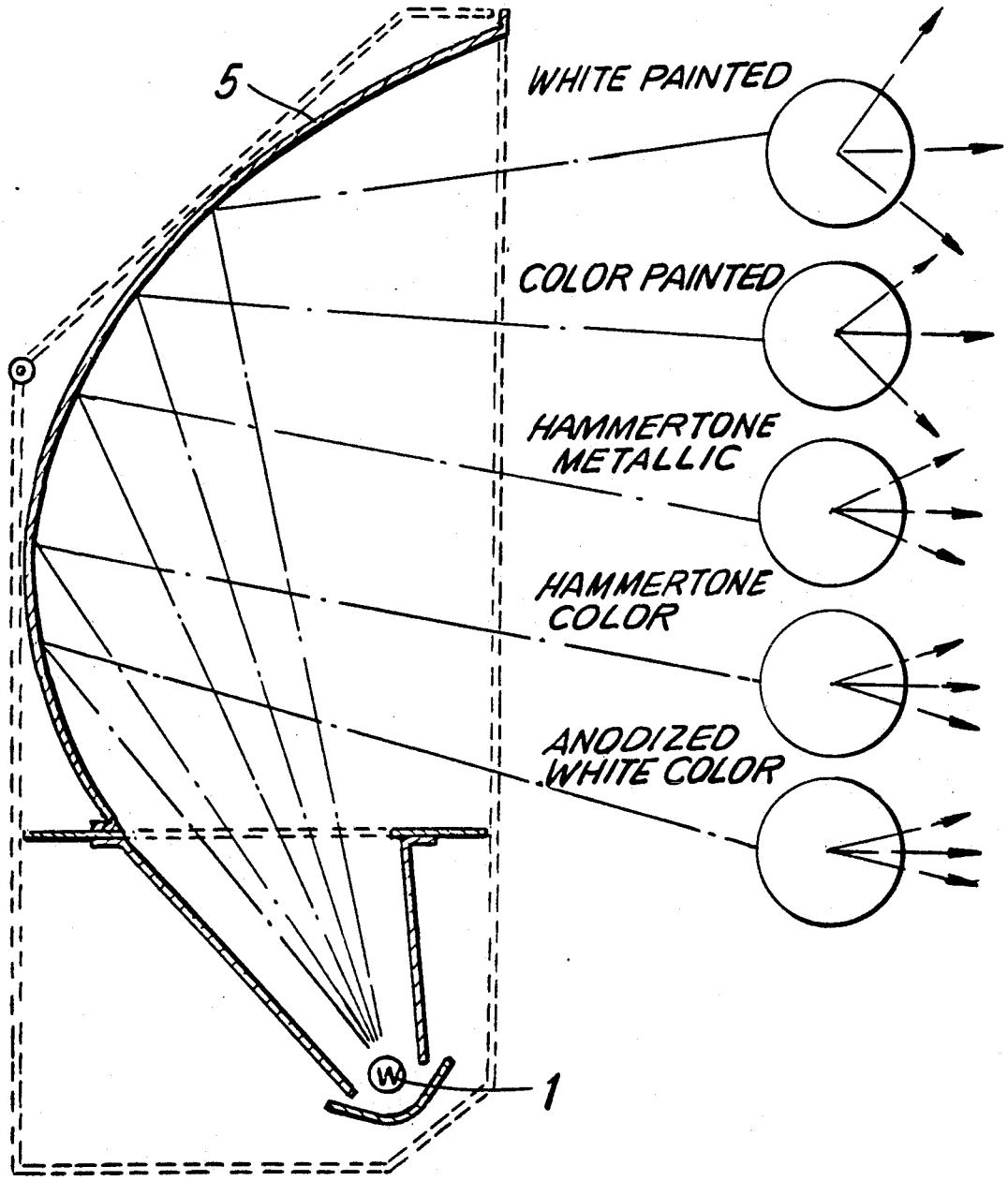
FIG. 7 shows various types of reflector surfaces and their angles of light dispersion.

FIG. 7 shows the different angles of light dispersion for different types of rear reflectors 5. A narrow angle of dispersion as with the anodiodes white color or hammer-tone color, boosts the light output efficiency while making it "harsher" or "less soft", producing harder shadows, than with a wider angle of dispersion as with white painted or color painted reflectors.

Figure 8A:
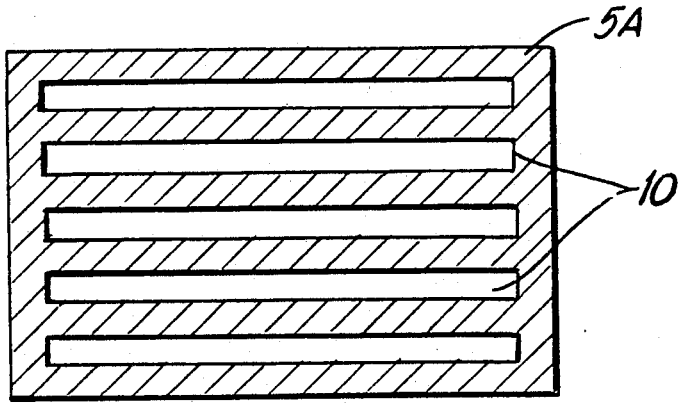
FIGS. 8*a*–8*c* shows an alternate version of the rear reflector.
Figure 8B:
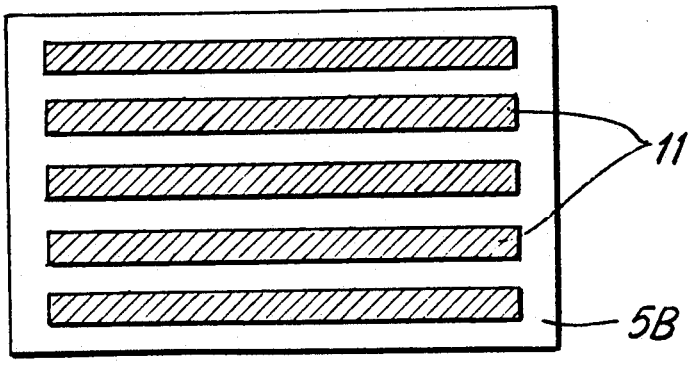
Figure 8C:
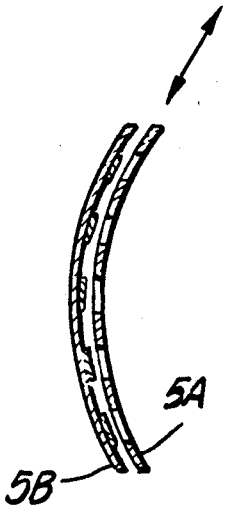

FIGS. 8*a*–8*c* shows an alternate construction of the rear reflector 5, which is made up of two parts 5*a*, 5*b*. Part 5*a* has slot openings 10 and part 5*b* has a reflector with black painted slot strips 11 matching the slot openings 10 in part 5*a*.

Moving part 5*a* against part 5*b* changes a full white reflector surface to a 50% black-stripe reflecting surface. This type of rear reflector 5 allows a continuous adjustment of light output without affecting the color temperature of the device.

Turning once again to FIG. 3, the reflector 7, 8 are connected to the housing 4 by way of ribs 12 which project inwardly from the walls of the housing. The reflectors 7 and 8 are fastened to these ribs 12 and are angled therefrom so as to provide appropriate reflection of the light emitting from the bulb 1. The rear reflector 5 is also fastened at its lower end to one of the ribs 12, while at its upper ends it is engaged between the front wall of the housing 4 and the front edge of the pivotable portion 9 of the housing. The lower portion of the rear reflector 5 is connected to the rib 12 so that it is easily disconnectible so that the rear reflector can be removed and replaced as desired so that the soft light device provides the desired lighting characteristics.

It can thus be seen that the arrangement of the reflectors 5–8, allow the overall device to have a housing 4 which is of relatively shallow construction as compared with prior art devices. Furthermore, the interchangeability of the rear reflector 5 permits a single soft light device to be used to provide a nearly infinite number of lighting characteristics.

While the invention has been illustrated and described as embodied in a soft light, it is not intended to limited the details shown, since various modifications and structural changes may be made without departing in any way from the spirit of the present invention.

Without further analysis, the foregoing will so fully reveal the gist of the present invention that others can, by applying current knowledge, readily adapted for various applications without omitting features that, from the standpoint of prior art, fairly constitute essential characteristics of the generic or specific aspects of this invention.

What is claimed as new and desired to be protected by Letters Patent is said forth in the appended claims.

What is claimed is:

1. A soft light, comprising:

a housing having a front opening and a hinged upper portion;

a light source arranged in a lower frontal position in said housing;

internal reflector means for directing light from said light source toward a rear portion of said housing opposite the front opening; and a rear reflector removably mounted at the rear portion of said housing so as to reflect the light from the light source and the internal reflector means out of the front opening of said housing.

2. A soft light as defined in claim 1, wherein said internal reflector means includes a spherical reflector mounted in said housing so as to partially surround a lower frontal portion of said light source, said internal reflector means further including two mirror reflectors mounted in said housing at a side of said light source opposite said spherical reflector, said mirror reflectors being arranged so as to diverge from said light source toward said rear reflector in order to direct light from said light source toward said rear reflector.

3. A soft light as defined in claim 1, wherein said rear reflector is removable from said housing via the hinged upper portion, and is interchangeable with a different rear reflector.

4. A soft light as defined in claim 1, wherein said rear reflector has an adjustable light output which does not affect color temperature of the light, said reflector having a first part with slot openings and a second part which is a reflector with black strips which correspond to the slot openings of the first part, the first and second parts being movable relative to one another in a sliding manner so that the rear reflector is adjustable between a full white reflector and a 50% black-striped reflecting surface.

5. A soft light as defined in claim 1, wherein said rear reflector is white painted.

6. A soft light as defined in claim 1, wherein said rear reflector is color painted.

7. A soft light as defined in claim 1, wherein said rear reflector is hammer-tone metallic.

8. A soft light as defined in claim 1, wherein said rear reflector is hammer-tone color.

9. A soft light as defined in claim 1, wherein said rear reflector is anodized white.

10. A soft light as defined in claim 1, wherein said rear reflector has a hard enamel finish.

* * * * *